United States Patent [19]

Gerking et al.

[11] 4,318,676

[45] Mar. 9, 1982

[54] DEVICE FOR SPINNING ENDLESS FILAMENTS

[75] Inventors: Lüder Gerking; Günter Panke, both of Berlin, Fed. Rep. of Germany

[73] Assignee: Karl Fischer Industrieanlagen GmbH, Fed. Rep. of Germany

[21] Appl. No.: 185,189

[22] Filed: Sep. 8, 1980

[30] Foreign Application Priority Data

Sep. 17, 1979 [DE] Fed. Rep. of Germany ... 7926583[U]

[51] Int. Cl.[3] ..... D01D 7/00

[52] U.S. Cl. ..... 425/72 S; 264/103; 264/176 F; 425/382.2

[58] Field of Search ..... 425/72 S, 382.2; 264/176 F, 103

[56] References Cited

U.S. PATENT DOCUMENTS

| | | | |
|---|---|---|---|
| 3,435,108 | 3/1969 | Hendry | 425/72 S |
| 3,881,850 | 5/1975 | Stockbridge | 425/72 S |
| 3,902,833 | 9/1975 | Matovinovic | 425/72 S |
| 3,936,253 | 2/1976 | Fisher et al. | 425/72 S |
| 4,077,752 | 3/1978 | Zahn | 425/72 S |
| 4,247,505 | 1/1981 | Jackson | 264/176 Z |

FOREIGN PATENT DOCUMENTS

| | | | |
|---|---|---|---|
| 1551401 | 12/1968 | France | 264/176 Z |
| 42-2931 | 2/1967 | Japan | 264/176 Z |
| 43-6093 | 3/1968 | Japan | 425/382.2 |

*Primary Examiner*—Jay H. Woo

*Attorney, Agent, or Firm*—Basile, Weintraub & Hanlon

[57] ABSTRACT

A device for spinning endless filaments out of synthetic polymers is disclosed. The device comprises a plurality of spin positions with each spin position having a spin head with four spinneret holders each fed by a multiple spin pump of a blowing chamber, a spin finish device and a winding device with at least two winding axes. The device is characterized in that one spinneret is in each spinneret holder and the spinneret can be fed by a spin pump with at least dosed melt streams, the quantity of which is designed for spinning four, eight or twelve ends per spin position which are adapted to be wound up thereafter.

5 Claims, 8 Drawing Figures

DEVICE FOR SPINNING ENDLESS FILAMENTS

BACKGROUND OF THE INVENTION

I. Field of the Invention

The present invention relates to a device for spinning endless filaments of synthetic polymers.

II. Description of the Prior Art

When spinning endless filaments out of synthetic polymers, such as polyamides, polyesters or polypropylene, one trys to keep the capacity of each spin position as high as possible. Such a spin position consists of a spin head, spin pumps (dosing pumps) and spinnerets in spinneret holders, blowing chamber, spin finish device and winder. Usually, several spin heads are combined to a spin beam, likewise the winders, arranged below, to a winding machine. A melt distributor is preconnected to the spin heads, a melting device to this melt distributor, nowadays usually is an extruder. The higher the capacity per spin position, the better the exploitation of this device, and the lower investment costs for a synthetic fiber plant. This results in the fact that up to 16 ends are produced per spin position, e.g., by spinning 16 ends out of a spin head, fitted with four spinneret holders (spin packs); each spinneret holder being fitted with two spinnerets, which are divided up semicircular or kidney-shaped, into two spinnerets each, or the spin head consists of eight spinneret holders with two spinnerets each so that in both cases altogether 16 melt streams are produced which are individually fed. Subsequently, 16 filaments are leaving the spin head. A filament, also called an end, means several single filaments or capillaries which are combined to one filament and then wound up. On the one hand, the limitation of increasing the capacity per spin position is to be seen in the decrease of filter surface in front of the spinnerets caused by increasing the filament numbers, and on the other hand in the limited number of bobbins to be wound per winding axis. When increasing the speed, i.e., a further possibility to increase capacity per spin position, handling of a great number of filaments becomes more and more difficult.

Parallel to the development of spin equipment suitable for the highest possible number of filaments, spin speed was increased. This resulted in a sudden further development of a spin system when it became obvious that not only economy of spinning was influenced, but the filament itself, when exceeding a certain speed.

In the case of POY spinning, i.e., preoriented yarn, within a range of more than 3.000 m/min and high-speed spinning in a range of up to 6.000 m/min winding speed, it is usual to spin either four and eight or six and twelve ends per spin head/spin position. Thus, four ends—in the case of a titer of 150 denier (relevant to 165 dtex)—are spun out of four spinnerets in four spinneret holders; in the case of a smaller titer of 75 den (83 dtex) eight ends out of eight spinnerets in four spinneret holders. Thus, the capacities are nearly the same whereas in case of four end spinning of 75 den, the throughput would only be half of it. In the last few years oil depending raw materials, such as synthetic polymers, have become more and more expensive. Furthermore, the clothing industry tends towards lighter clothes. Consequently, finer titers were produced, i.e., from 75 den to 40 den, and, in the case of polyester, even to 30 den. In the case of polyamide, hosieries are already of 20 den and finer.

SUMMARY OF THE INVENTION

This innovation represents a spin equipment that can be used for both POY spinning within a range of more than 3.000 m/min and high-speed spinning up to 6.000 m/min with titer ranges from 150 den down to 50 den, while attaining the same capacity per spin position.

According to the innovation, the aim is reached by the characteristics given in claim 1.

Further developments are resulting from the subclaims.

The objects, advantages and applications of the present invention will become apparent to those skilled in the art of devices for spinning endless filaments when the following description of the best mode contemplated for practicing the invention is read in conjunction with the accompanying drawings.

BRIEF DESCRIPTION OF THE DRAWINGS

The description herein makes reference to the accompanying drawings wherein like numerals refer to like components throughout the several views, and wherein.

DESCRIPTION OF THE PREFERRED EMBODIMENT

Figure 1:
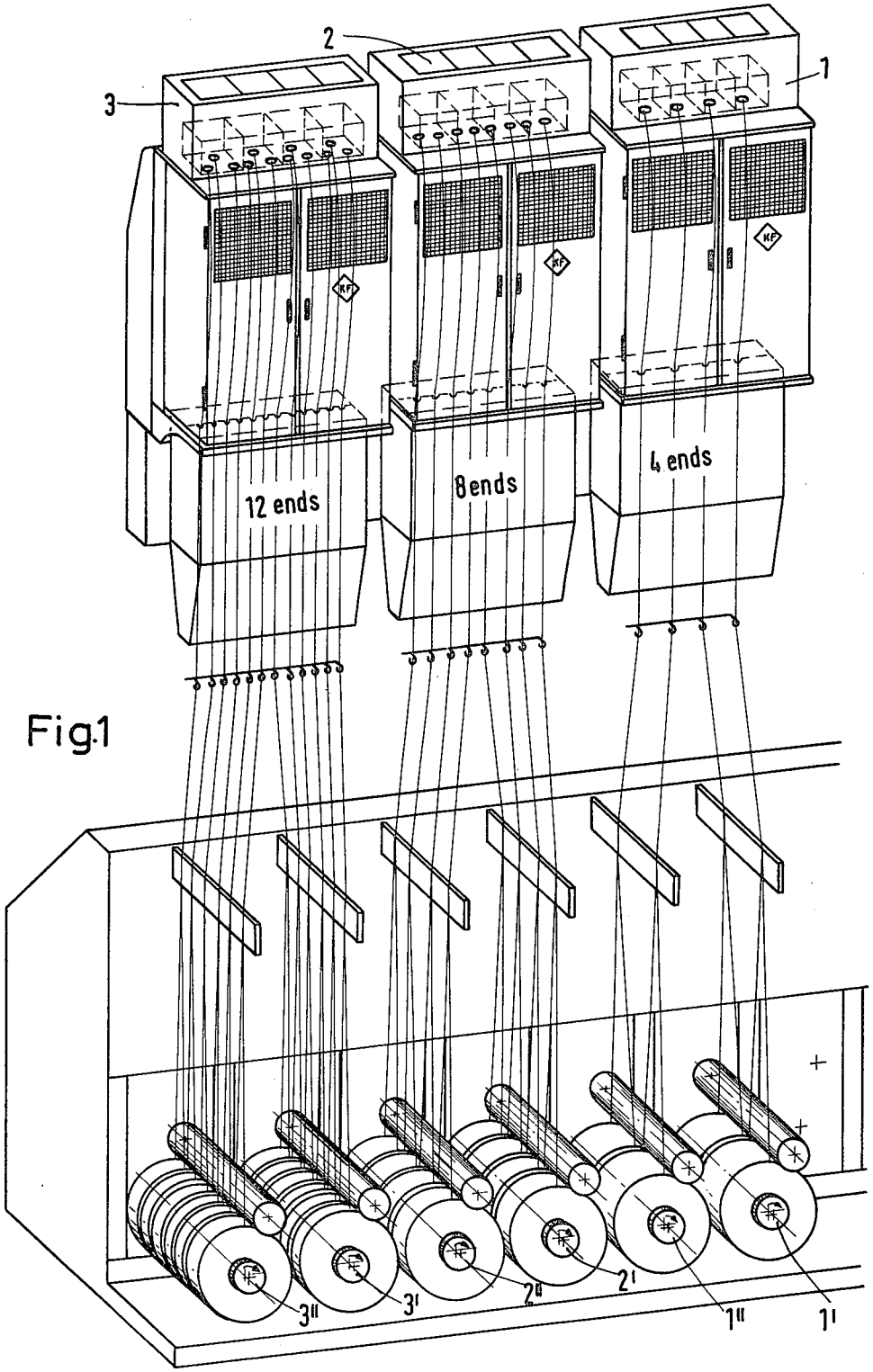
FIG. 1 is a perspective view of a device for spinning endless filaments out of synthetic polymers.

According to the design as per FIG. 1, three spin positions are arranged side by side. Spin head 1 spins four ends, spin head 2 eight ends and spin head 3 twelve ends. The relevant number of ends are wound on the below arranged winding axes 1' and 1'', 2' and 2'', 3' and 3''.

Figures 2B, 2C:
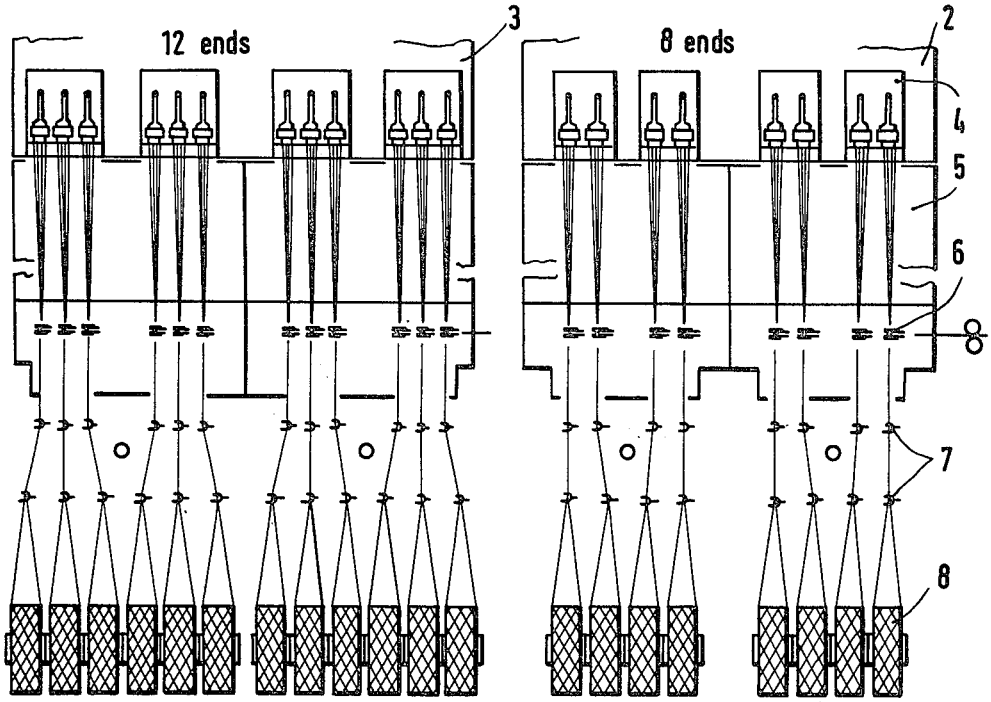
FIGS. 2*a*, 2*b* and 2*c* are schematic drawings for respectively spinning and winding ends in the case of four, eight and twelve end spinning.
Figure 2A:
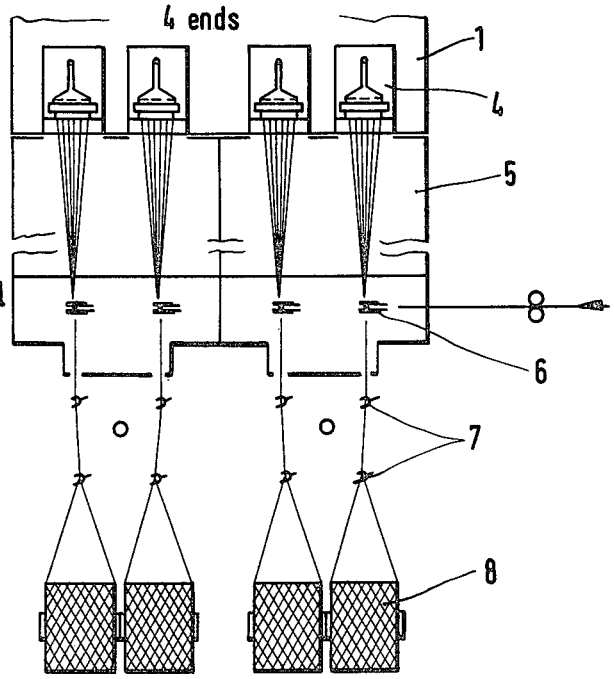

FIGS. 2*a*, 2*b* and 2*c* are schematic drawings for spinning and winding ends in the case of four, eight and twelve end spinning. Spin head 3 with spinneret holders 4 is joined to the blowing chamber 5, the spin finish device 6, the thread guides 7 and the winders 8.

FIG. 2*a* shows the device for four end spinning with one spinneret per spinneret holder, FIG. 2*b* shows one with two spinnerets, and FIG. 2*c* shows one with three spinnerets per spinneret holder. The individual winding axes are accordingly fitted with two, four or six bobbins. FIG. 2*a* indicates the possibility of operating four bobbins on one axis, whereas the second one is not in operation.

This system of four, eight and twelve end spinning requires winders with long spinneret holders, which are able to take up to six bobbins and spin pumps which can easily be converted for two or three dosed melt streams, just by exchanging the intermediate plates, and finally the arrangement of three spinnerets in one spinneret holder. Nowadays, winders with the necessary spinneret holders, suitable for up to six bobbins, are available on the market. The common gear dosing pump can easily be converted. Though it was up to now unknown how to arrange three spinnerets in one pack for spinning endless filaments, it may be attained nowadays by making the described steps.

Figure 3C:
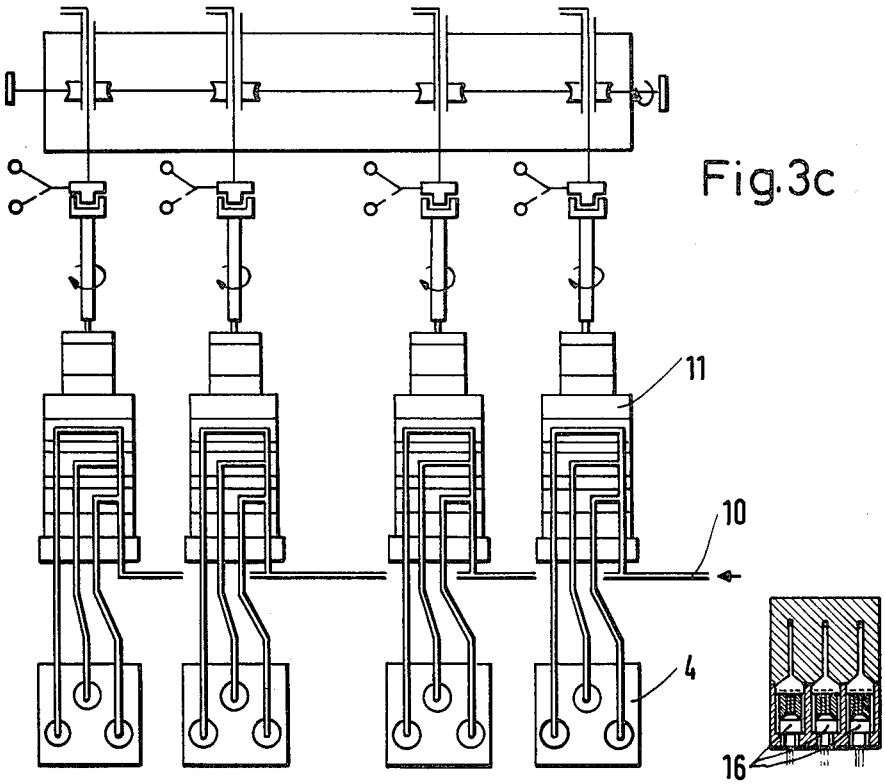
FIGS. 3*a*, 3*b* and 3*c* are schematic drawings of the melt flow from a supply line.
Figure 3B:
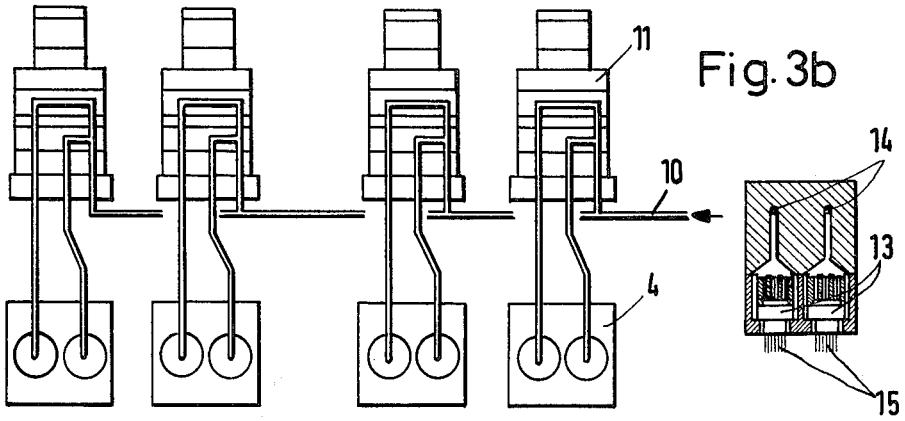
Figure 3A:
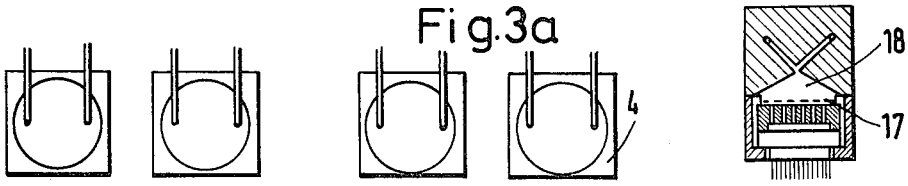

FIGS. 3*a*, 3*b* and 3*c* are schematic drawings of the melt flow from a supply line 10 via spin pump 11 to the spinneret holder 4. The spin pumps are driven on switch gears, as already known; the space between pump and gear, arising when changing from eight end to twelve end spinning (FIGS. 3*b* and 3*c*), is compensated by pump intermediate plates (also called protective plates). Now as before, each spinneret 13 in FIG. 3*b* is fed by double spin pump 11 through single bores 14. Thus, the melt quantities leaving the spinnerets are already dosed for the subsequent spinning of capillaries 15. The same is shown in FIG. 3*c*, but here spinnerets 16 are fed with equal melt quantities by a three fold spin pump 11.

In order to avoid a further modification of the spin pump when converting from four end to eight end spinning, the two separate melt streams of the double spin pump are combined into one stream within the spinneret holder in FIG. 3*a* above the spin plate in section 18 above the filter 17 when spinning four ends.

Self-evidently, it is possible to arrange three or even four winding axes per spin position instead of two. The shown equipment with the two winding axes, each one able to take a maximum of six bobbins, is, however, an optimum one.

Figure 4:
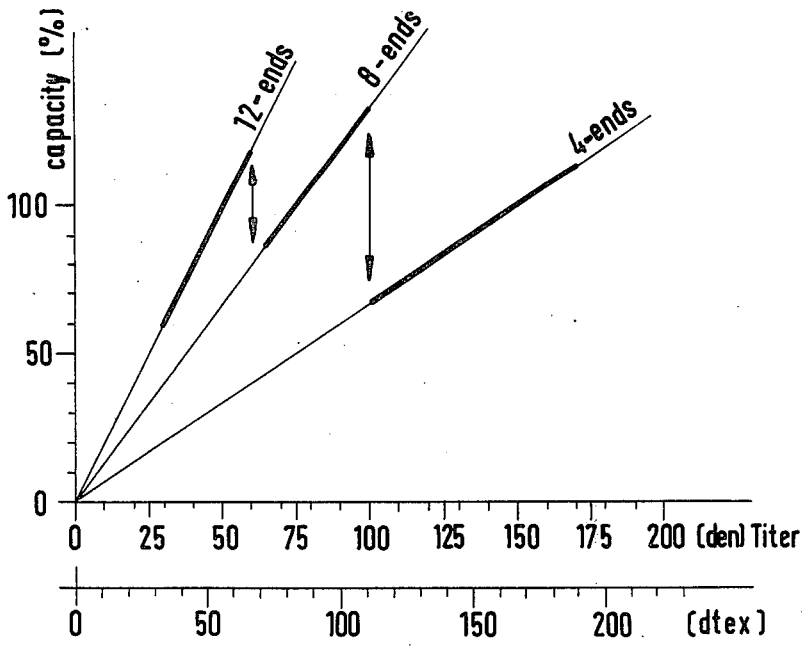
FIG. 4 is a diagram of the capacity verses titer for four, eight and twelve end spinning operations.

The diagram in FIG. 4 shows the operation. The characteristic lines of four, eight and twelve end spinning always pass the zero point. The design of this exemplary spin system shown in FIG. 4 allows one to attain a capacity of 100% at 150 den when spinning four ends, at 75 den when spinning eight ends and at 50 den when spinning twelve ends. In practical operation these values differ slightly from the theoretical ones, because the smaller the titer of the single capillaries, the finer the residual drawing ratio becomes, which is necessary for the subsequent draw-twisting or crimping of filament titer of, e.g., 75 den or 40 den. When decreasing the residual drawing ratio, capacity must be reduced accordingly, whereas waste is slightly higher in the case of a higher total titer due to frequent exchange of bobbins.

The spin unit is operated according to the thick characteristic lines of FIG. 4. As soon as the capacity attains a certain limit value for one titer, operation is converted to another characteristic by modifying the plant, e.g., at 100 den from four to eight end spinning, and at 60 den from eight to twelve end spinning. In one case of the described device, the spin heads are arranged side by side with a spacing of 1.000 mm in one spin beam. Each spin head consists of four spinneret holders, as already described. The spinneret holders are installed into and dismantled from the top of the spin head.

It does not matter if there are two or three feeding lines. The individual spinneret holder is always fastened to the seat of the spin pump, the so-called pump block, by one screw only. Thus, the spinneret can be exchanged when spinning twelve ends as quickly as when spinning eight and four ends.

In the case of twelve end spinning, the spinnerets have three nozzles per spinneret holder which are so arranged that the individual capillaries do not cover those of the adjacent nozzles, securing an equal cooling down. The spinneret surface, determining the size of filtering surface and thus spinneret service life as well as the number of bores to be arranged per spinneret for capillaries to be spun per filament, is 50 mm when spinning twelve ends, 64 mm when spinning eight ends and 120 mm when spinning four ends. The indicated diameters refer to smallest spinneret diameter, where the spinneret exceeds the spinneret holder.

With this spinning system an enormous adaptability to different titer programs within the production is obtained and also large spinneret diameters in the spin system. Thus, the demand of a long spinneret service life and of as many capillaries as possible is fulfilled.

When spinning at 3.000 m/min instead of conventional spinning between 800 and 1.500 m/min, a yarn is produced which can directly be draw-texturized without prior draw-twisting. Thus, one big process step is saved. The further development of POY spinning within a range of more than 3.000 m/min to high-speed spinning allows the production of yarns which may directly be used for textile treatment without intermediate drawing process.

It should be understood by those skilled in the art of such devices that other forms of the invention can be had without departing from the spirit of the invention or scope of the appended claims.

What is claimed is as follows:

1. In a device for spinning endless filaments out of synthetic polymers, said device comprising a plurality of spin positions, each single spin position of it having a spin head with four spinneret holders; a multiple spin pump feeding said holders; a blowing chamber; a spin finish device and a winding device with at least two winding axes, the improvement characterized in that one spinneret at least is in each spinneret holder, and that said spinneret can be fed by one of said spin pumps with at least two dosed melt stream, the quantity of which is designed for spinning a different number of ends per spin position wherein the number of ends produced at each spin position varies by a ratio of 3:2:1.

2. The improvement of claim 1 characterized in that the winder, belonging to the spin head consists of two winding axes, each one designed for taking up to six bobbins.

3. The improvement of claim 1 characterized in that two spinnerets are provided in each spinneret holder.

4. The improvement of claim 1 characterized in that three spinnerets are installed in one spinneret holder each.

5. The improvement of claim 1 or claim 4 characterized in that the spinnerets can be fed by a spin pump with three dosed melt streams.

* * * * *